US012269661B2

(12) United States Patent
Ford

(10) Patent No.: US 12,269,661 B2
(45) Date of Patent: Apr. 8, 2025

(54) CARRIER FOR CONTAINERS

(71) Applicant: Graphic Packaging International, LLC, Atlanta, GA (US)

(72) Inventor: Colin P. Ford, Woodstock, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 46 days.

(21) Appl. No.: 18/202,017

(22) Filed: May 25, 2023

(65) Prior Publication Data

US 2023/0382619 A1 Nov. 30, 2023

Related U.S. Application Data

(60) Provisional application No. 63/345,965, filed on May 26, 2022.

(51) Int. Cl.
*B65D 71/40* (2006.01)
*B65D 71/42* (2006.01)

(52) U.S. Cl.
CPC .... *B65D 71/42* (2013.01); *B65D 2571/00197* (2013.01); *B65D 2571/00259* (2013.01);
(Continued)

(58) Field of Classification Search
CPC .. B65D 2571/00444; B65D 2571/0016; B65D 2571/00543; B65D 2571/00759; B65D 2571/00716; B65D 2571/0066; B65D 2571/00277; B65D 2571/0029; B65D 71/42
(Continued)

(56) References Cited

U.S. PATENT DOCUMENTS 1,527,399 A 2/1925 Davidson
2,289,859 A 7/1942 Arthur
(Continued)

FOREIGN PATENT DOCUMENTS

EP 0 352 589 B1 10/1992
JP 2003-146359 5/2003
(Continued)

OTHER PUBLICATIONS

International Search Report and Written Opinion for PCT/US2023/023535 dated Sep. 15, 2023.

*Primary Examiner* — King M Chu
(74) *Attorney, Agent, or Firm* — Womble Bond Dickinson (US) LLP

(57) ABSTRACT

A carrier for holding a plurality of containers, the carrier includes a plurality of panels including an attachment panel, a first side panel foldably connected to the attachment panel, and a second side panel foldably connected to the attachment panel, container retention features including a plurality of container openings in the attachment panel for at least partially receiving a respective container of the plurality of containers, and locking features for maintaining a secure engagement of the carrier with the plurality of containers, the locking features including at least one locking tab foldably connected to one of the first side panel and the second side panel, and at least one locking cut at least partially receiving the at least one locking tab, the at least one locking cut positioned in the other of the first side panel and the second side panel.

49 Claims, 6 Drawing Sheets

(52) U.S. Cl.
CPC ..... *B65D 2571/00444* (2013.01); *B65D 2571/0066* (2013.01)

(58) Field of Classification Search
USPC ..... 206/427, 158, 147, 153, 152
See application file for complete search history.

(56) References Cited

U.S. PATENT DOCUMENTS 2,522,950 A 9/1950 Keith
2,798,603 A 7/1957 Grinspoon
2,950,041 A 8/1960 Stone
2,974,851 A 3/1961 Struble
3,137,109 A 6/1964 Rapata
3,528,697 A 9/1970 Wood
3,587,847 A * 6/1971 Graser ..... B65D 71/44 294/87.2
3,601,439 A 8/1971 Poupitch
3,627,121 A 12/1971 Deasy
3,897,873 A 8/1975 Graser
3,942,631 A 3/1976 Sutherland et al.
4,029,204 A 6/1977 Manizza
4,250,991 A 2/1981 Manizza et al.
4,304,329 A 12/1981 Graser
4,372,599 A 2/1983 Kiedaisch et al.
4,378,879 A 4/1983 Killy
4,382,505 A 5/1983 Sutherland et al.
4,784,266 A 11/1988 Chaussadas
5,058,735 A 10/1991 Bienaime
5,139,147 A 8/1992 Sutherland
5,188,225 A 2/1993 Jorba
5,246,113 A 9/1993 Schuster
5,267,644 A 12/1993 Tsao
5,297,673 A * 3/1994 Sutherland ..... B65D 71/16 206/427
5,310,050 A 5/1994 Sutherland
5,310,051 A 5/1994 Sutherland
5,318,178 A 6/1994 Davies et al.
5,323,895 A 6/1994 Sutherland et al.
5,328,024 A 7/1994 Sutherland
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,443,153 A 8/1995 Sutherland
5,445,262 A 8/1995 Sutherland
5,452,799 A 9/1995 Sutherland
5,503,267 A 4/1996 Sutherland
5,520,283 A 5/1996 Sutherland
5,524,756 A 6/1996 Sutherland
5,538,133 A 7/1996 Campbell et al.
5,542,536 A 8/1996 Sutherland
5,551,566 A 9/1996 Sutherland
5,553,705 A 9/1996 Bakx
5,593,027 A 1/1997 Sutherland
5,706,936 A 1/1998 Bernstein
5,711,419 A 1/1998 Beales et al.
5,746,310 A 5/1998 Slomski
5,791,463 A 8/1998 Negelen
5,816,391 A 10/1998 Harris
5,819,920 A 10/1998 Sutherland
5,878,877 A 3/1999 Sutherland
5,960,945 A 10/1999 Sutherland
6,039,181 A 3/2000 Whiteside
6,059,099 A 5/2000 Galbierz
6,315,111 B1 11/2001 Sutherland
6,394,272 B1 5/2002 Domansky
6,896,130 B2 5/2005 Theelen
7,011,209 B2 3/2006 Sutherland et al.
7,278,538 B2 10/2007 Chargueraud
8,387,784 B2 3/2013 Gonzalez et al.
8,424,677 B2 4/2013 Spivey, Sr. et al.
8,443,968 B2 5/2013 De Paula
8,469,184 B2 6/2013 Spivey, Sr.
8,925,720 B2 1/2015 Sutherland et al.
D946,418 S 3/2022 Gonzalez et al.
11,485,555 B2 11/2022 Gonzalez Manzano et al.
2002/0017476 A1 2/2002 Le Bras
2002/0195371 A1 12/2002 Brown
2003/0080004 A1 5/2003 Olsen et al.
2003/0213705 A1 11/2003 Woog
2005/0127151 A1 6/2005 Johnson
2009/0101526 A1 4/2009 Sutherland et al.
2009/0127147 A1 5/2009 Sutherland

FOREIGN PATENT DOCUMENTS

JP 2006-151468 A 6/2006
WO WO 95/04687 A1 2/1995
WO WO 2011/006151 A2 1/2011
WO WO-2021195454 A1 * 9/2021 ..... B65D 71/42

* cited by examiner

CARRIER FOR CONTAINERS

CROSS-REFERENCE TO RELATED APPLICATION

This application claims the benefit of U.S. Provisional Patent Application No. 63/345,965, filed on May 26, 2022.

INCORPORATION BY REFERENCE

The disclosures of each of U.S. Provisional Patent Application No. 63/345,965, filed on May 26, 2022, and U.S. Design patent application Ser. No. 29/893,006, filed on May 24, 2023, are hereby incorporated by reference for all purposes as if presented herein in their entireties.

BACKGROUND OF THE DISCLOSURE

The present disclosure generally relates to cartons or carriers for holding, displaying, and/or transporting containers.

SUMMARY OF THE DISCLOSURE

According to one aspect, the disclosure is generally directed to a carrier for holding a plurality of containers, the carrier comprising a plurality of panels comprising an attachment panel, a first side panel foldably connected to the attachment panel, and a second side panel foldably connected to the attachment panel container retention features comprising a plurality of container openings in the attachment panel for at least partially receiving a respective container of the plurality of containers, and locking features for maintaining a secure engagement of the carrier with the plurality of containers, the locking features comprising at least one locking tab foldably connected to one of the first side panel and the second side panel, and at least one locking cut at least partially receiving the at least one locking tab, the at least one locking cut positioned in the other of the first side panel and the second side panel.

According to another aspect, the disclosure is generally directed to a blank for forming a carrier for holding a plurality of containers, the blank comprising a plurality of panels comprising an attachment panel, a first side panel foldably connected to the attachment panel, and a second side panel foldably connected to the attachment panel, container retention features comprising a plurality of container openings in the attachment panel for at least partially receiving a respective container of the plurality of containers when the carrier is formed from the blank, and locking features for maintaining a secure engagement of the carrier with the plurality of containers when the carrier is formed from the blank, the locking features comprising at least one locking tab foldably connected to one of the first side panel and the second side panel, and at least one locking cut for at least partially receiving the at least one locking tab when the carrier is formed from the blank, the at least one locking cut positioned in the other of the first side panel and the second side panel.

According to another aspect, the disclosure is generally directed to a method of forming a carrier for holding a plurality of containers, the method comprising obtaining a blank, the blank comprising a plurality of panels comprising an attachment panel, a first side panel foldably connected to the attachment panel, and a second side panel foldably connected to the attachment panel, the blank further comprising container retention features comprising a plurality of container openings in the attachment panel, the blank further comprising locking features comprising at least one locking tab foldably connected to one of the first side panel and the second side panel, and at least one locking cut positioned in the other of the first side panel and the second side panel, and positioning the at least one locking cut at least partially receiving the at least one locking tab.

According to another aspect, the disclosure is generally directed to a package, the package comprising a plurality of containers and a package. The package comprises a plurality of panels comprising an attachment panel, a first side panel foldably connected to the attachment panel, and a second side panel foldably connected to the attachment panel, container retention features comprising a plurality of container openings in the attachment panel at least partially receiving a respective container of the plurality of containers, and locking features maintaining a secure engagement of the carrier with the plurality of containers, the locking features comprising at least one locking tab foldably connected to one of the first side panel and the second side panel, and at least one locking cut at least partially receiving the at least one locking tab, the at least one locking cut positioned in the other of the first side panel and the second side panel.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

DETAILED DESCRIPTION

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Packages according to the present disclosure can accommodate containers of numerous different shapes. For the purpose of illustration and not for the purpose of limiting the scope of the disclosure, the following detailed description describes beverage containers (e.g., generally cylindrical containers such as aluminum cans) at least partially disposed within the package embodiments. In this specification, the terms "lower," "bottom," "upper" and "top" indicate orientations determined in relation to fully erected packages.

Figure 1:
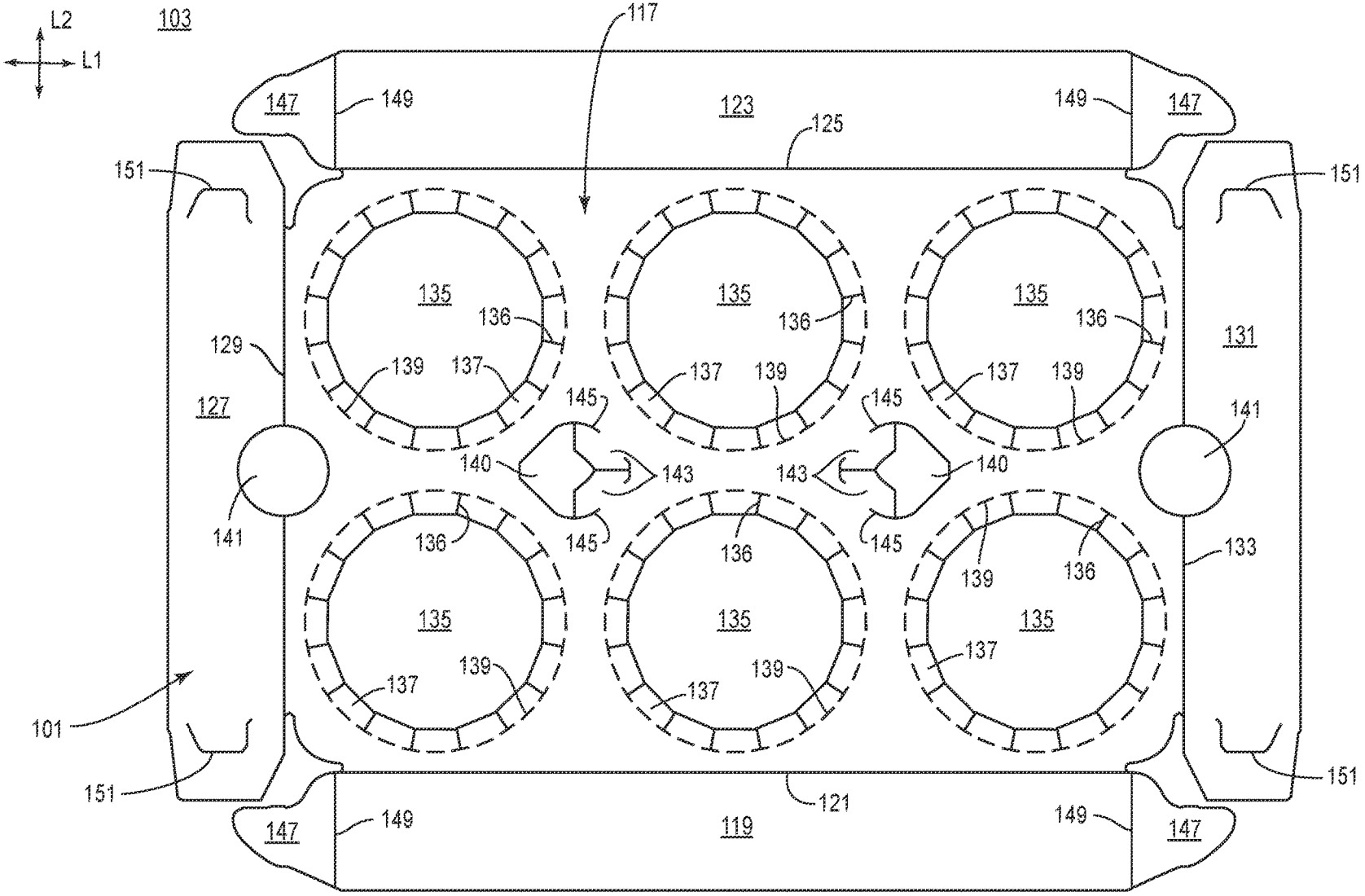
FIG. 1 is a plan view of an outer surface of a blank for forming a carrier according to a first exemplary embodiment of the disclosure.

FIG. 1 is a plan view of an exterior surface 101 of a blank 103 for forming a carrier 105 (FIG. 4) according to a first exemplary embodiment of the disclosure. As described further herein, the carrier 105 can be configured for holding/supporting/retaining/receiving a plurality of containers. The carrier 105 can be provided with one or more containers to form a package 110 (FIG. 4).

Figure 4:
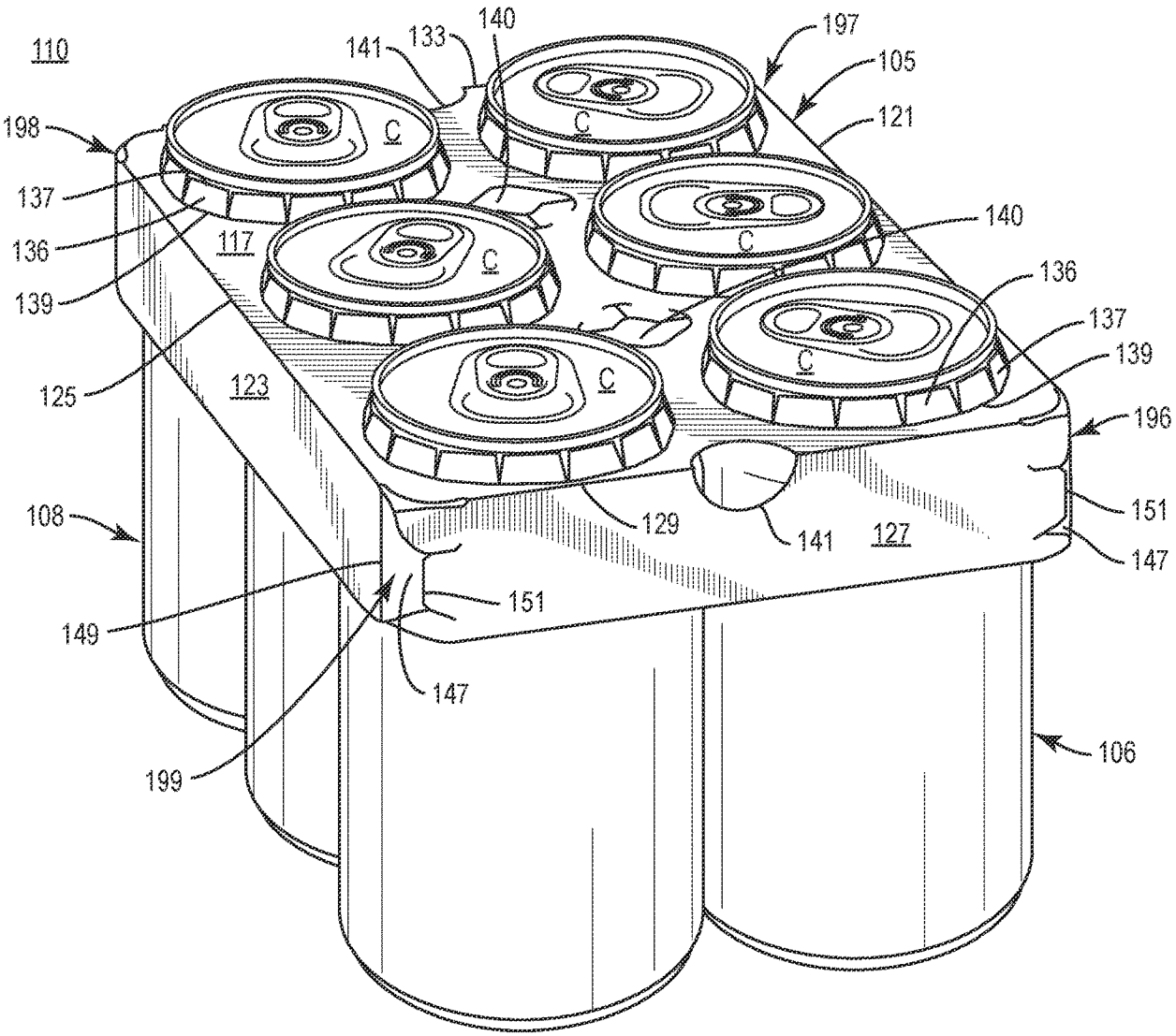
FIG. 4 is a perspective view of a package and carrier formed from the blank of FIG. 1 according to the first exemplary embodiment of the disclosure.

As shown in FIG. 4, the carrier 105 is sized to contain or support six containers C, with three containers C being attached to a front portion 106 of the carrier 105 and three containers C being attached to a back portion 108 of the carrier 105. It will be understood that the carrier 105 can be sized and shaped to hold more or less than six containers. In some embodiments, the front portion 106 and the back portion 108 of the carrier 105 each have three containers, and in other embodiments, the front portion 106 and the back portion 108 of the carrier 105 can carry more or less than three containers without departing from the disclosure.

In the illustrated embodiment, the containers C can be beverage cans having a lower base portion, a top portion generally comprising a neck that tapers inwardly from a flange portion at the top of the neck that extends radially outward from the neck, and a top surface below the flange portion that includes a pull-tab. It will be understood that one or more of the containers C can be another suitable type and size of container without departing from the disclosure.

Still referring to FIG. 1 the blank 103 has a longitudinal axis L1 and a lateral axis L2. In one embodiment, the axis L1 can be a lateral axis and the axis L2 can be a longitudinal axis. The blank 103 comprises a central panel or attachment panel 117 that includes container retention features for engaging and/or at least partially receiving containers C when the carrier 105 is formed from the blank 103, as described further herein.

In the illustrated embodiment, the blank 103 also comprises a front end flap or front side panel 119 (broadly, "first side panel" or "second side panel") foldably connected to the attachment panel 117 at a longitudinal fold line 121, a back end flap or back side panel 123 foldably connected to the attachment panel 117 at a longitudinal fold line 125, a first end flap or first end side panel 127 (broadly, "first side panel" or "second side panel") foldably connected to the attachment panel 117 at a lateral fold line 129, and a second end flap or second end side panel 131 foldably connected to the attachment panel 117 at a lateral fold line 133. It will be understood that one or more of the fold lines 121, 125, 129, 133 can be a different type of line a weakening, e.g., a tear line and/or having one or more perforations therealong, without departing from the disclosure.

The container retention features of the blank 103/central panel 117 can include a plurality of container openings 135). As shown, the container openings 135 can be provided in a column and row arrangement in a number that corresponds to a desired number of containers to be held by the carrier 105 formed from the blank 103. While the central panel 117 is shown having container openings 135 provided in two rows/columns of three openings 135 each, it will be understood that a different number and/or arrangement of container retention openings 135 can be provided without departing from the disclosure.

As shown in FIG. 1, the container openings 135 can have a generally circular configuration, with container retention tabs 137 at least partially foldably connected to the top panel 125 at respective oblique or curved fold lines 139 and circumferentially arranged extending into/toward the container openings 135. Adjacent container retention tabs 137 can be at least partially separated at a respective oblique cut 136. It will be understood that one or more of the container retention tabs 137 can have a different configuration or arrangement without departing from the disclosure. For example, in one embodiment, the container retention tabs 137 can have the form of edges of the central panel 117 that protrude into the respective container openings 135.

As also shown, the blank 103/carrier 105 can also have handle features that include a pair of handle openings 140 defined in the attachment panel 117 each generally between four adjacent container openings 135, and a pair of generally circular handle openings 141 at least partially defined in a portion of the attachment panel 117 and each of the respective side panels 127, 131.

In the illustrated embodiment, the handle openings 141 can intersect the respective fold lines 129, 133. The handle features can also include handle reinforcement flaps 143 foldably connected to the attachment panel 117 at respective oblique fold lines 145 and positioned extending at least partially into a respective handle opening 140. It will be understood that the blank 103/carrier 105 can have a different number and/or arrangement of handle features without departing from the disclosure.

With continued reference to FIG. 1, the blank 103 can include locking features for forming locking features of the carrier 105. In the illustrated embodiment, the locking features can include male locking features in the form of a pair of locking tabs 147 foldably connected to the respective front side panel 119 (broadly, respective "first locking tab" and "second locking tab") and the back side panel 123 (broadly, respective "third locking tab" and "fourth locking tab") at respective lateral fold lines 149. In some embodiments, the locking tabs 147 can have one or more surface features, e.g., notches, grooves, serrated edges, hooks, barbs, etc., for facilitating such engagement with the locking cuts 151/adjacent surfaces of the respective panels 119, 123.

The locking features can also include female locking features comprising respective a pair of locking cuts 151 (broadly, respective "first locking cut", "second locking cut", "third locking cut" and "fourth locking cut") positioned in the respective side panels 127, 131 and for at least partially receiving a respective locking tab 147, as described further herein. As shown, one or more of the locking cuts 151 can have one or more of straight, curved, and/or angled portions. In some embodiments, the locking cuts 151 can have a different configuration that is complementary to that of the locking tabs 147.

It will be understood that the blank 103 and carrier 105 formed therefrom can have a different number and/or arrangement of locking features without departing from the disclosure.

Figure 2:
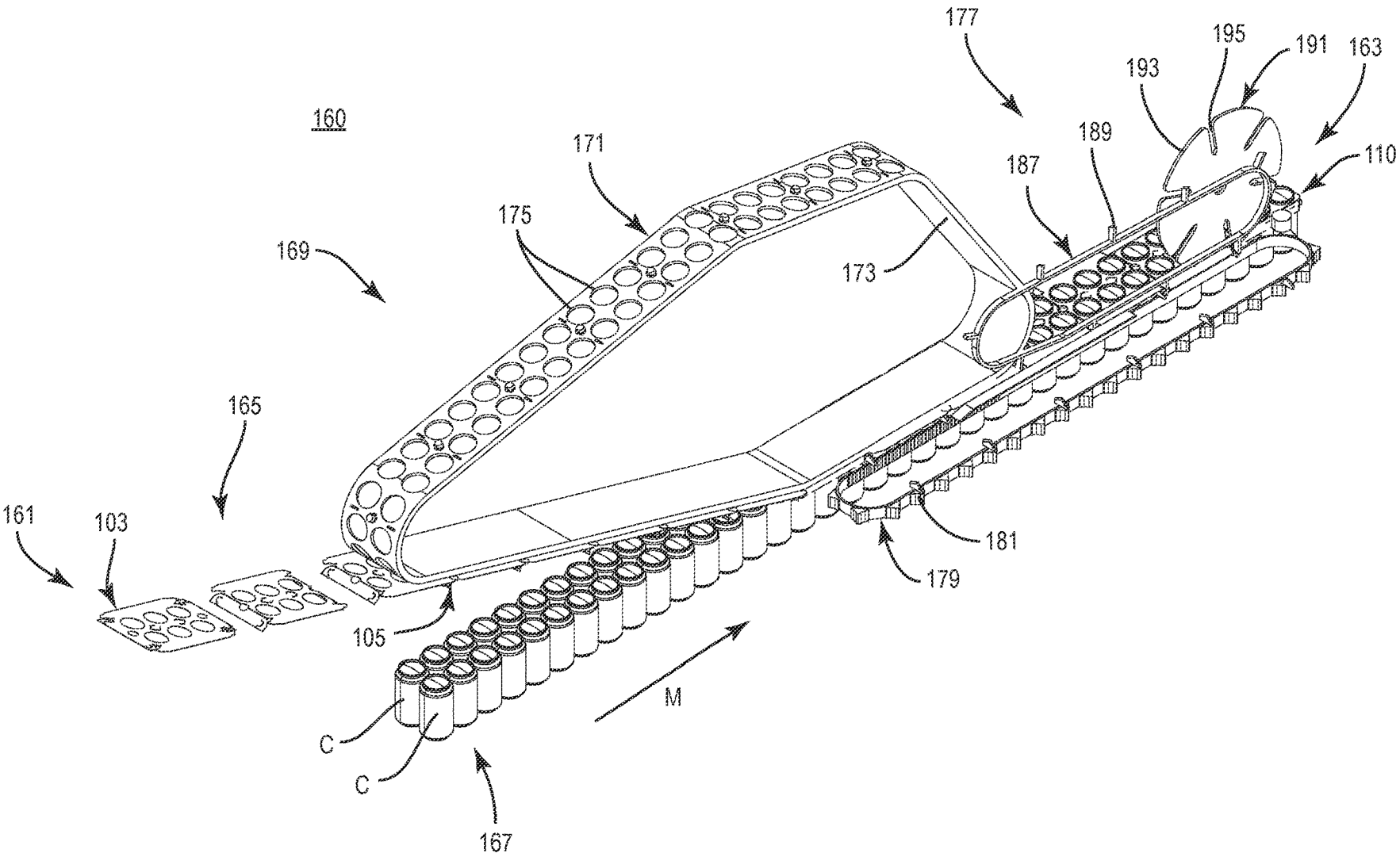
FIG. 2 is a perspective view of a portion of a system for forming carriers and packages from the blank of FIG. 1 according to an exemplary embodiment of the disclosure.

With additional reference to FIG. 2, a portion of a system 160 for forming carriers 105 and packages 110 from the blanks 103 is illustrated according to an exemplary embodiment of the disclosure. It will be understood that the system 160 can have one or more different components and/or arrangements without departing from the disclosure. In some embodiments, a different system or machinery can be provided for at least partially forming carriers and packages from the blanks 103. In some embodiments, different systems can be provided for forming each of carriers and packages from the blanks 103. In some embodiments, such systems can be or can include those described in U.S. Provisional Patent Application No. 63/261,582, filed on Sep. 24, 2021, the entire disclosure of which is incorporated by reference as if set forth herein in its entirety.

As described herein, the system 160 can be configured to form carriers 105 and packages 110 from the respective blanks 103. In this regard, the system 160 can be configured to manipulate (e.g., fold, bend, crease, otherwise move, etc.) one or more portions of the respective blanks 103 to form carriers 105, and, simultaneously or thereafter, bring such blanks 103/carriers 105 into engagement with containers C to form packages 110.

In the illustrated embodiment, the system 160 can include a blank infeed assembly 165 for receiving and moving one or more blanks 103 into the system 160, a product conveyor assembly 169 for moving one or more containers C through the system 160, and a package forming assembly 169 downstream from the blank infeed assembly 165 for at least partially engaging the blanks 103/carriers 105 with the containers C to form packages 110. The system 160 can have a different number, arrangement, and/or configuration of assemblies without departing from the disclosure.

It will be understood that one or more of such assemblies of the system 160 can have one or more intermediate transport assemblies, e.g., conveyors, belts, bedplates for cooperating with moving components, etc. Furthermore, the assemblies of the system 160 can be provided with one or more motors and suitable accompanying transmission mechanisms, e.g. a transmission shaft, one or more sets of gearing, rollers, belts, wheels, etc. to apply a rotational force one or more components of such assemblies. In some embodiments, one or more of the assemblies of the system 160 can be provided with one or more dedicated motors. In some embodiments, one or more motors can be activated to provide driving forces to multiple assemblies of the system 160.

A motor as described herein can be any type of motor, engine, actuator, or other driving device that operates by converting energy, e.g., electrical energy and/or chemical fuel into a mechanical energy output.

It will be understood that the system 160 can include a machine frame supporting the various assemblies and components thereof described herein. The machine can include one or more of bases, legs, struts, tie bars, platforms, etc., in various arrangements, to provide a supporting structure for the assemblies and components described herein. For example, the machine frame can support such components above a base surface such as a ground or floor, and can provide access at one or more locations for human operators, e.g., to inspect, maintain, and/or otherwise operate the system 160. In one embodiment, the system 160 can be provided without an external frame.

Figure 3:
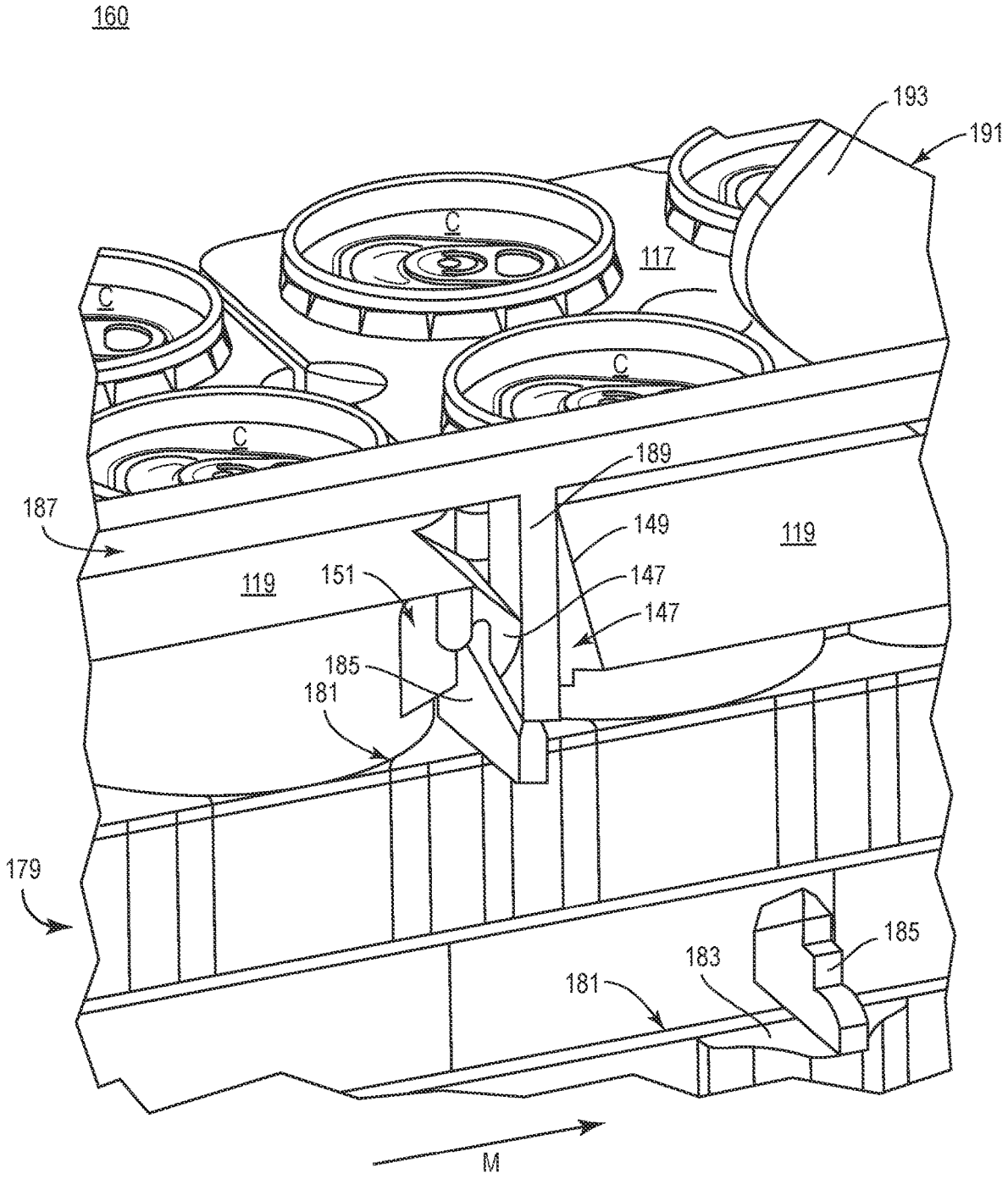
FIG. 3 is an enlarged view of the portion of the system of FIG. 2.

With continued reference to FIGS. 2 and 3, the blanks 103 can move through the system 160 from an upstream end 161 to a downstream end 163 thereof generally in a downstream direction or machine direction M that defines/is parallel to a downstream direction with regard to the system 163 and such that the blanks 103 are engaged by various portions and components of the system 160. In this regard, an upstream direction with regard to the system 160 is a direction opposite the machine direction M/downstream direction.

The system 160 can include the blank infeed assembly 165 proximate the upstream end 161 thereof for receiving and sequentially distributing blanks 103 in the machine direction M of the system 160. Accordingly, the system 160 can include a feeder mechanism such as a hopper, chute, or other in-line or right-angle distribution mechanism (now shown). An accompanying blank transport mechanism, e.g., a conveyor, bedplate with rolling components, etc., can be provide in cooperation with such a feeder mechanism for transporting the blanks 103 in the downstream direction.

Still referring to FIGS. 2 and 3, the system 160 can also include the product conveyor assembly 167 for moving containers C in the machine direction M. Such product conveyor assembly 167 can include at least one moving support upon which the containers C are placed for downstream movement along the system 160. Such moving supports can include conveyors, belts, bedplates, rollers, etc. that are at least partially driven, e.g., by one or more shared or dedicated drive assemblies, to move the containers C supported thereon. In some embodiments, the product conveyor assembly 167 can be configured to at least partially group containers C into a desired arrangement such that groups of a preselected number and/or arrangement of containers C can be formed.

The system 160 can further include the package forming assembly 169 positioned downstream from the blank infeed assembly 165 in the machine direction M, and along which the product conveyor assembly 167 at least partially extends. The package forming assembly 169 can include a forming belt or clipping belt 171 extending around, e.g., forming an outer perimeter, about a series of rollers or a closed loop drive belt 173 in at least partial face-to-face contact below the clipping belt 171 such that the clipping belt 171 is arranged in a closed path. As described further herein, the drive belt 173 can be driven to rotate to carry at least a portion of the clipping belt 171 proximate the containers C in the machine direction M.

The clipping belt 171, as shown, can be a generally flat member having a plurality of openings 175 formed therethrough. The clipping belt 171 can be formed of a material suitable to withstand applied tension and/or engagement with the respective drive belt 173 and associated drive components. In one embodiment, the clipping belt 171 can include one or more of polymeric materials, composite materials, and metallic materials. In one embodiment, the clipping belt 171 can include one or more reinforcing members, e.g., embedded structures, binders, braids, etc.

As described further herein, the openings 175 in the clipping belt 171 can be formed in with a diameter/arrangement corresponding to that of the container openings 135 and container retention tabs 137 of the blank 103. In the illustrated embodiment, the openings 175 in the clipping belt 171 can have a diameter that corresponds to a distance from a curved fold line/portion of the curved fold line 139 to a diametrically opposed portion of the curved fold line/curved fold line 139.

The aforementioned arrangement of the clipping belt 171 is such that that when the clipping belt 171 is arranged in a generally planar arrangement above a respective blank 103, respective openings 175 in the clipping belt 171 can be aligned with the container openings 135 in the blank 103. In some embodiments, the clipping belt 171 can include one or more surface features, e.g., protrusions, recesses, frictionally enhanced surfaces, etc., to facilitate engagement with the blanks 103 and/or subsequent engagement with containers C.

It will also be understood that the system 160 described above can be adjusted to accommodate different types/arrangements/dimensions of blanks 103, e.g., so as to minimize the number of replacement/change parts involved with utilizing the system 160 for different blanks, e.g., to streamline operations and minimize downtime. For example, one or more adjustment controls, e.g., levers, knobs, toggles, buttons, tools (such as wrenches), can be coupled to one or more tolerance adjusting features of the system 160 (e.g., nuts, bolts, screws, clamps, vices, jacks, lifts, cranks, wheels, etc.).

As also shown, the package forming assembly 169 can include a locking apparatus 177 positioned downstream from the clipping belt 171. The locking apparatus 177, as shown, can include a leading locking belt 179 positioned adjacent the path of the containers C along the product conveyor assembly 175 in the downstream direction. The locking belt 179 can be arranged along a closed loop and can support a plurality of first locking lugs 181, as shown.

As shown in FIG. 3, each locking lug 181 can include a base 183 attached to the locking belt 179 and an arm 185 supported on the base and at least partially intersecting the path of the containers C. Accordingly, the locking belt 179 can be driven to rotate such that the lugs 181 are carried along with the arms 185 extending toward the carriers 105/packages 110 for engagement with one or more portions thereof.

The locking apparatus 177 can further include a trailing locking belt 187 positioned adjacent the path of the containers C, and which defined a plurality of second locking lugs 189 extending therefrom. While the second locking lugs 189 are illustrated as projections of the trailing locking belt 187, it will be understood that the second locking lugs 189 can be a separate structure attached to the locking belt 187 without departing from the disclosure. Like the leading locking belt 179, the trailing locking belt 187 can be driven to rotate such that the lugs 189 are positioned to be carried into engagement with one or more portions of the carriers 105/packages 110.

The blank processing assembly 169 can further include a flap folding wheel or panel folding wheel 191 positioned adjacent the path along which the carriers 105/containers C advance in the system 160, and can include a plurality of radially-extending sections 193 separated by respective circumferential gaps 195. As described further herein, the folding wheel 191 can be driven to rotate, e.g., by one or more motors/drive systems of the system 160, via engagement with one or more of the locking belts 179, 187, etc., such that the sections 193 thereof are moved into engagement with one or more portions of the carriers 105/packages 110 passing thereby.

With continued reference to FIGS. 2 and 3, during use, the one or more drive assemblies associated with the system 160 can be activated, e.g., via activation/energization of one or more motors or prime movers, to cause the blank infeed assembly 165/associated conveyor to advance one or more blanks 103 in the downstream direction and/or otherwise toward the package forming assembly 169.

As the blanks 103 reach the package forming assembly 169, the blanks 103 can engage, for example, in at least partial face-to-face contact, a portion of the clipping belts 171 facing downwardly.

As the clipping belt 171 and the containers C approach registration, e.g., in a path parallel to the machine direction M, the blank(s) 103 carried by the clipping belt 171 can be positioned overlying upper portions of the containers C. It will be understood that the containers C can be grouped into a desired group/arrangement along the product conveyor assembly 167 and/or prior to loading onto the product conveyor assembly 167.

In such an arrangement, the package forming assembly 169 can urge the blanks 103 carried on the clipping belt 169 into a clipping engagement with respective groups of containers C, e.g., such that the rims of the containers C are at least partially received in respective container openings 135 to cause the respective container retention tabs 137 to separate further from one another and fold at least partially upwardly at the respective fold lines 139 into an edge-to-surface or bracing engagement with the underside of the rims of the containers C. In such a position, the container retention tabs 137 can extend from the attachment panel 117 to the underside of the rim of a respective container C to maintain engagement of the blank 103/carrier 105 with the containers C.

Further downstream movement of the engaged blanks 103/carriers 105/containers C along the package forming assembly 169 is such to pass adjacent the locking belts 179, 187. It will be understood that the locking belts 179, 187 can be driven in different rotational directions. In some embodiments, the leading locking belt 179 can be driven such that a portion thereof closest to the packages 110 is generally opposite the machine direction M, and the trailing locking belt 187 can be driven such that a portion thereof closest to the packages 110 is generally along the machine direction M. In some embodiments, the locking belts 179, 187 can be driven in a different rotational direction than described above. In some embodiments, the locking belts 179, 187 can be driven in the same rotational direction.

As the locking lugs 181 attached to the locking belt 179 approach the locking tabs 147 adjacent the respective second end side panels 131, the arms 185 thereof can be at least partially inserted between adjacent packages 110 to cause respective portions of an end side panel 131 of a leading package 110 and the side panel 127 of an immediately adjacent leading package 110 to at least partially move inwardly, e.g., transverse to the machine direction M, to position the respective locking cuts 151 for receiving respective locking tabs 147.

Similarly, as the lugs 189 extending from the locking belt 187 are inserted between adjacent packages 110, the lugs 189 cause a locking tab 147 foldably connected to the side panel 119 of the leading package 110 and a locking tab 147 foldably connected to the side panel 119 of the immediately adjacent leading package 110 to at least partially move through the respective locking cuts 151 to lock the corners of the respective packages 110.

As also shown, further downstream movement of the packages 110 into engagement with the locking wheel 191 is such that the sections 193 thereof can be rotated into engagement with the respective front side panel 119 and back side panel 123 to further fold the side panels 119, 123 at the respective fold lines 121, 125 to overlap respective portions of the side panels 127, 131 to facilitate formation of the carrier 105/package 110 and engagement of the locking features.

It will be understood that one or more of the side panels 119, 123, 127, 131 of the blanks 103 can be additionally or alternatively folded at the respective fold lines 121, 125, 129, 133 at one or more upstream portions of the system 160, e.g., via engagement with one or more lugs, arms, cams, folding surfaces, etc., to facilitate the aforementioned formation of the carriers 105 and packages 110.

Furthermore, while the package forming apparatus 169 and associated components have been illustrated as positioned for engaging a front portion of the blanks 103/carriers 105/packages 110, it will be understood that additional such components can be positioned along the back portions of such blanks 103/carriers 105/packages 110 for engagement thereof in a manner similar to that described above with regard to the front portions of the blanks 103/carriers 105/packages 110.

With additional reference to FIG. 4, engagement of the locking features of the carriers 105/packages 110 as described above is illustrated. As the locking tabs 147 and adjacent locking cuts 151 are brought into engagement via action of the system 160 as described above, the respective locking tabs 147 can be at least partially inserted/received between the edges of the respective locking cuts 151 in the respective front side panels 119 and back side panel 123.

In this regard, the locking tabs 147 can engage one or more interior surfaces of the respective front side panel 119 and back side panel 123 to maintain engagement between the front side panel 119 and back side panel 123 and the respective side panels 127, 131 attached thereto via the respective locking tabs 147 to maintain the formed configuration of the carrier 105/package 110. Furthermore, the edges of the respective locking cuts 151 can compressibly/frictionally engage one or more portions of the respective locking tabs 147. In some embodiments, the locking tabs 147 can have one or more surface features, e.g., notches, grooves, serrated edges, hooks, barbs, etc., for facilitating such engagement with the locking cuts 151/adjacent surfaces of the respective panels 119, 123.

As described herein, a lateral portion of at least the side panel 119 adjacent the side panel 127 can be at least partially curved and overlapped in at least partial face-to-face contact by a respective portion of the side panel 127 to form a first at least partially curved corner 196 of the carrier 105/package 110 between the side panels 119, 127. Similarly, a lateral portion of at least the side panel 119 adjacent the side panel 131 can be at least partially curved and overlapped in at least partial face-to-face contact by a respective portion of the side panel 131 to form a second at least partially curved corner 197 of the carrier 105/package 110 between the side panels 119, 131. A lateral portion of at least the side panel 123 adjacent the side panel 131 can be at least partially curved and overlapped in at least partial face-to-face contact by a respective portion of the side panel 131 to form a third at least partially curved corner 198 of the carrier 105/package 110 between the side panels 123, 131. A lateral portion of at least the side panel 123 adjacent the side panel 127 can be at least partially curved and overlapped in at least partial face-to-face contact by a respective portion of the side panel 127 to form a fourth at least partially curved corner 199 of the carrier 105/package 110 between the side panels 123, 127

The aforementioned engagement of the locking features of the carrier 105/package 110 can create a secure and tightened arrangement of the carrier 105/package 110 that can further enhance the engagement between the attachment panel 117 and the respective containers C at least partially extending therethrough. For example, in some embodiments, the engagement of the respective locking tabs 147 with the respective locking cuts 151 can exert compressive forces along one or more portions of the attachment panel 117 to provide a compressed engagement of the edges of the attachment panel 117 surrounding the respective container openings 135 and/or the container retention tabs 137 extending therefrom with the respective containers C.

Furthermore, such secure and tightened arrangement of the carrier 105/package 110 can be achieved without the use of adhesives such as glue, e.g., to provide a condensed/renewable waste stream that avoids the use of polymeric materials. Further still, the system 160 can be provided in a simplified arrangement that obviates the need for steps sometimes associated with gluing operations, e.g., turning of product packs, etc.

It will be understood that the carrier 105/package 110 can have a different configuration without departing from the disclosure.

Figure 5:
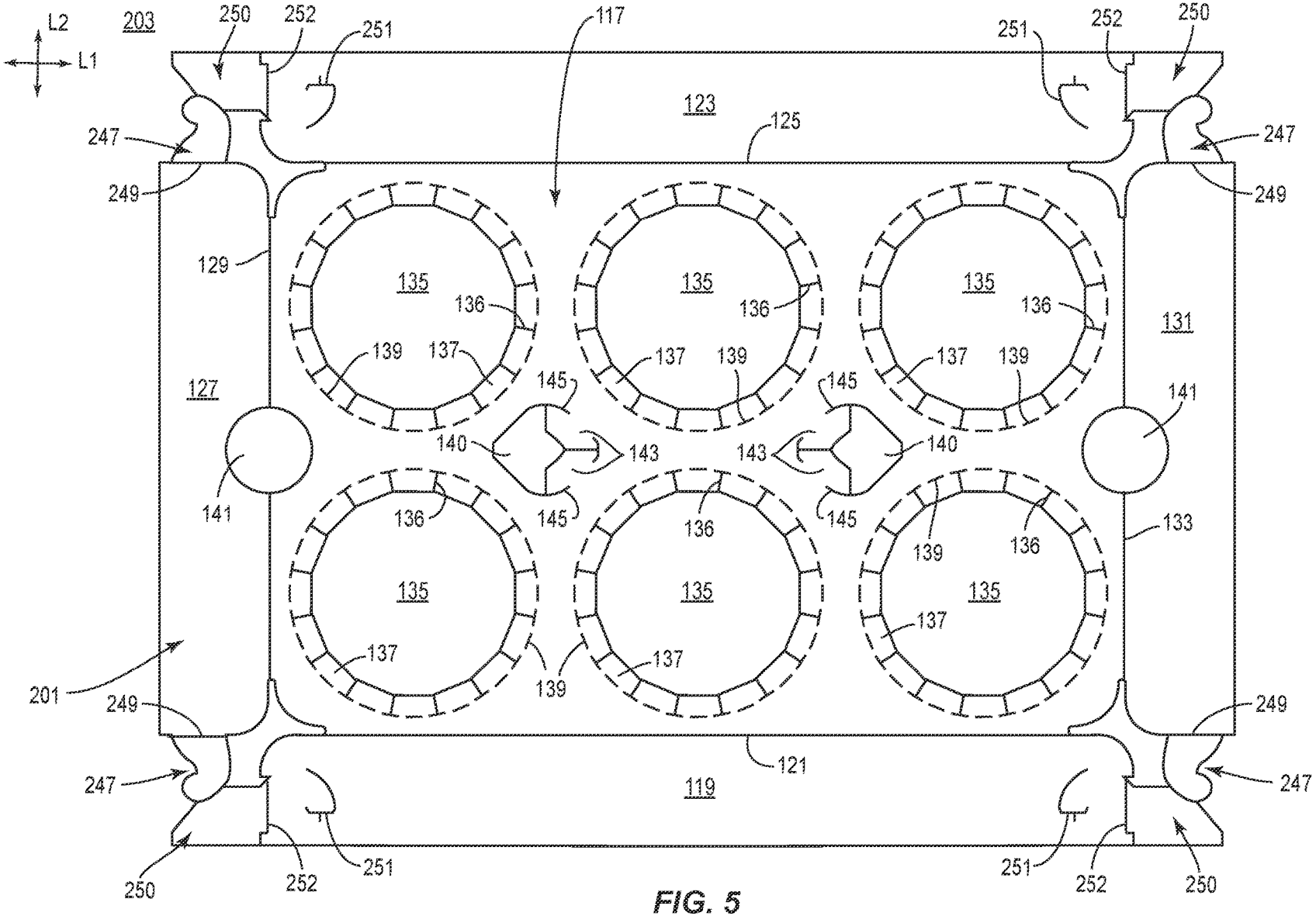
FIG. 5 is a plan view of an exterior surface of a blank for forming a package and carrier according to a second exemplary embodiment of the disclosure.

For example, and with additional reference to FIG. 5, an exterior surface 201 of a blank 203 for forming a carrier 205 and package 210 (FIG. 6) according to a second exemplary embodiment of the disclosure is illustrated. The blank 203 and carrier 205/package 210 formed therefrom can have one or more features that are the same or similar to those described above with respect to the blank 103 and carrier 105/package 110, and like or similar features are designated with like or similar reference numerals.

For example, the blank 203 and carrier 205/package 210 formed therefrom can include the panels 117, 119, 123, 127, 131, and associated container retention features.

However, and as shown, the blank 203 and carrier 205/package 210 formed therefrom can include a different configuration of locking features than described above with respect to the blank 103/carrier 105/package 110. In particular, the blank 203 can include locking tabs 247 foldably connected to the side panels 127, 131 at respective longitudinal lines of weakening or fold lines 249, and having a generally hook-shaped or at least partially curved configuration.

Furthermore, locking cuts 251 positioned in the front side panel 119 and the back side panel 123 (broadly, respective "first locking cut", "second locking cut", "third locking cut" and "fourth locking cut") for at least partially receiving the respective locking tabs 247 can have a respective curved portion intersecting a straight portion so as to form a cut that is complementary to the configuration of the locking tabs 247.

Further still, locking features of the blank 203 and carrier/package formed therefrom can include a tucking end flap 250 foldably connected to the respective front side panel 119 (broadly, respective "first tucking end flap" and "second tucking end flap") and back side panel 123 (broadly, respective "third tucking end flap" and "fourth tucking end flap") at respective lateral fold lines 252.

Figure 6:
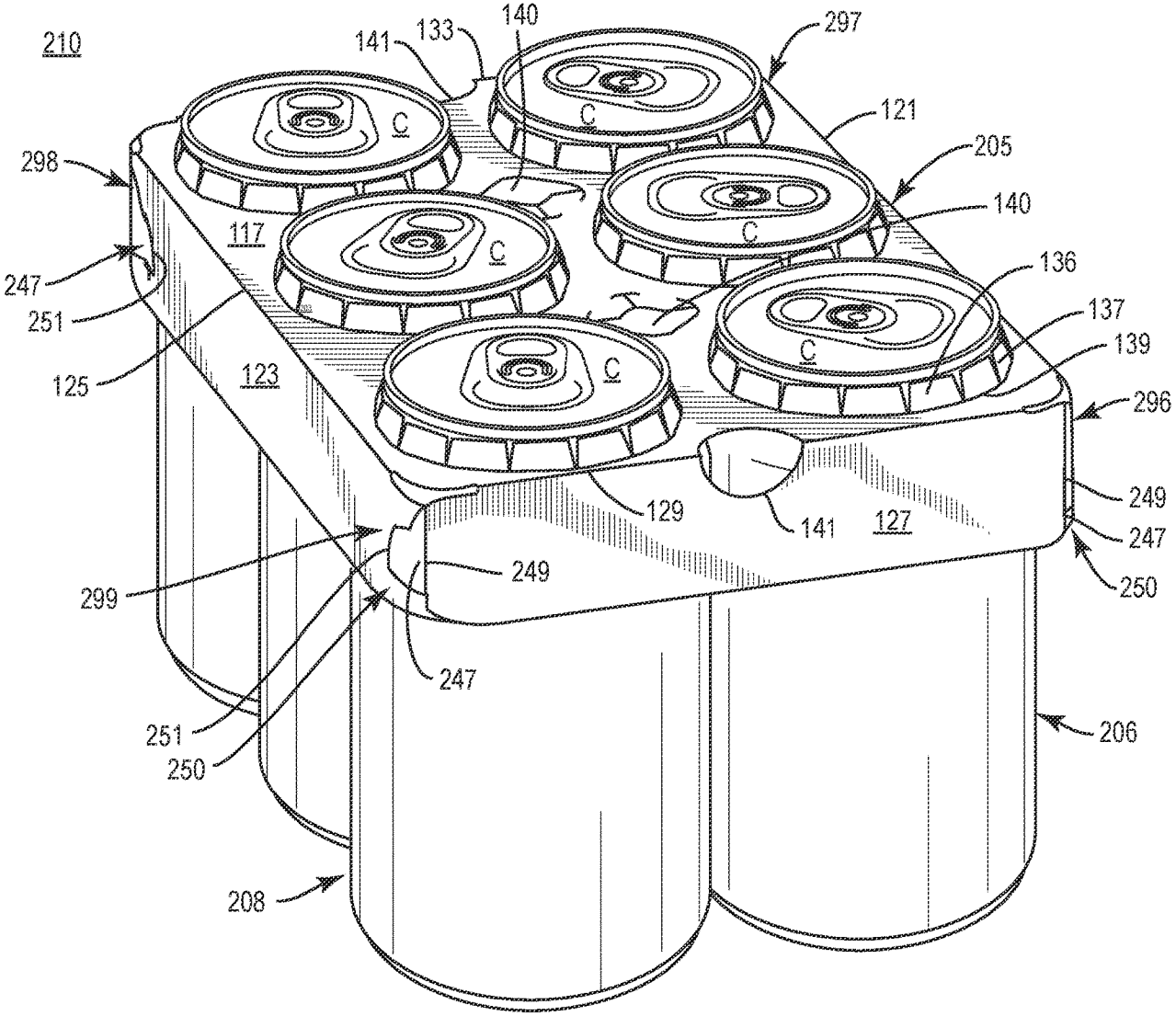
FIG. 6 is a perspective view of a package and carrier formed from the blank of FIG. 5 according to the second exemplary embodiment of the disclosure Corresponding parts are designated by corresponding reference numbers throughout the drawings.

With additional reference to FIG. 6, the blank 203 can be formed into the carrier 205 and coupled with one or more containers C to form the package 210 in a manner similar to that described above with respect to the blank 103/carrier 105/package 110, e.g., via the system 160 or a different system or method, with the locking tabs 247 at least partially inserted through openings formed by the respective cuts 251 to facilitate a secure and tightened engagement of as described above with regard to the carrier 105/package 110.

Furthermore, the tucking end flaps 250 can be at least partially folded at the respective fold lines 252 or otherwise positioned in at least partial face-to-face contact with the respective locking tabs 247 and/or adjacent portions of the respective side panels 127, 131 to further urge the respective locking features together to facilitate the secure and tightened engagement thereof. For example, in some embodiments, the tucking end flaps 250 can facilitate frictional engagement with respective locking tabs 247 and/or adjacent portions of the respective side panels 127, 131 to further secure the carrier 205/package 210 to the containers C, to avoid inadvertent disengagement thereof, etc.

As described herein, a lateral portion of the side panel 119 and/or tucking end flap 250 adjacent the side panel 127 can be at least partially curved and overlapped in at least partial face-to-face contact with a respective portion of the side panel 127 to form a first at least partially curved corner 296 of the carrier 205/package 210 between the side panels 119, 127. Similarly, a lateral portion of at least the side panel 119 and/or tucking end flap 250 adjacent the side panel 131 can be at least partially curved and overlapped in at least partial face-to-face contact by a respective portion of the side panel 131 to form a second at least partially curved corner 297 of the carrier 205/package 210 between the side panels 119, 131. A lateral portion of at least the side panel 123 and/or tucking end flap 250 adjacent the side panel 131 can be at least partially curved and overlapped in at least partial face-to-face contact by a respective portion of the side panel 131 to form a third at least partially curved corner 298 of the carrier 205/package 210 between the side panels 123, 131. A lateral portion of at least the side panel 123 and/or tucking end flap 250 adjacent the side panel 127 can be at least partially curved and overlapped in at least partial face-to-face contact by a respective portion of the side panel 127 to form a fourth at least partially curved corner 299 of the carrier 205/package 210 between the side panels 123, 127.

In this regard, a carrier 205 and package 210 having a front portion 206 and a back portion 208 can be formed from the blank 203 in a manner similar to that described above with respect to the formation of the carrier 105 and package 110 from the blank 103, and with similar advantages and functionality.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels comprising an attachment panel, a first side panel foldably connected to the attachment panel, and a second side panel foldably connected to the attachment panel;

container retention features comprising a plurality of container openings in the attachment panel for at least partially receiving a respective container of the plurality of containers; and locking features for maintaining a secure engagement of the carrier with the plurality of containers, the locking features comprising at least one locking tab foldably connected to one of the first side panel and the second side panel, and at least one locking cut at least partially receiving the at least one locking tab, the at least one locking cut positioned in the other of the first side panel and the second side panel, the locking features forming an at least partially curved corner of the carrier between the first side panel and the second side panel.

2. The carrier of claim 1, wherein at least a portion of the first side panel is curved to at least partially form the at least partially curved corner.

3. The carrier of claim 2, wherein the locking features further comprise a tucking end flap foldably connected to the one of the first side panel and the second side panel having the at least one locking cut, the tucking end flap at least partially overlapping the other of the first side panel and the second side panel.

4. The carrier of claim 2, wherein the container retention features further comprise a plurality of container retention tabs foldably connected to the attachment panel and extending into a respective container opening of the plurality of container openings, the plurality of container retention tabs for engaging a respective container of the plurality of containers.

5. The carrier of claim 4, further comprising handle features, the handle features comprising at least one handle opening at least partially formed in the attachment panel.

6. The carrier of claim 1, wherein the first side panel is a front side panel, the second side panel is a first end side panel, the at least one locking tab is foldably connected to the front side panel, the at least one locking cut is positioned in the first end side panel, and the plurality of panels further comprises a back side panel foldably connected to the attachment panel and a second end side panel foldably connected to the attachment panel.

7. The carrier of claim 6, wherein the at least one locking tab is a first locking tab foldably connected to the front side panel, the at least one locking cut is a first locking cut positioned in the first end side panel, and the locking features further comprise a second locking tab foldably connected to the front side panel, a third locking tab foldably connected to the back side panel, a fourth locking tab foldably connected to the back side panel, a second locking cut positioned in the first end side panel and at least partially receiving the third locking tab, a third locking cut positioned in the second end side panel and at least partially receiving the second locking tab, and a fourth locking cut positioned in the second end side panel and at least partially receiving the fourth locking tab.

8. The carrier of claim 7, wherein the locking features form a first at least partially curved corner between the front side panel and the first end side panel, a second at least partially curved corner between the front side panel and the second end side panel, a third at least partially curved corner between the second end side panel and the back side panel, and a fourth at least partially curved corner between the back side panel and the first end side panel.

9. The carrier of claim 1, wherein the first side panel is a front side panel, the second side panel is a first end side panel, the at least one locking tab is foldably connected to the first end side panel, the at least one locking cut is positioned in the front side panel, and the plurality of panels further comprises a back side panel foldably connected to the attachment panel and a second end side panel foldably connected to the attachment panel.

10. The carrier of claim 9, wherein the at least one locking tab is a first locking tab foldably connected to the first end side panel, the at least one locking cut is a first locking cut positioned in the front side panel, and the locking features further comprise a second locking tab foldably connected to the first end side panel, a third locking tab foldably connected to the second end side panel, a fourth locking tab foldably connected to the second end side panel, a second locking cut positioned in the front side panel and at least partially receiving the third locking tab, a third locking cut positioned in the back side panel and at least partially receiving the second locking tab, and a fourth locking cut positioned in the back side panel and at least partially receiving the fourth locking tab.

11. The carrier of claim 10, wherein the locking features form the at least partially curved corner between the front side panel and the first end side panel being a first at least partially curved corner, a second at least partially curved corner between the front side panel and the second end side panel, a third at least partially curved corner between the second end side panel and the back side panel, and a fourth at least partially curved corner between the back side panel and the first end side panel.

12. The carrier of claim 11, wherein the locking features further comprise a first tucking end flap foldably connected to the front side panel and in at least partial face-to-face contact with the first end side panel, a second tucking end flap foldably connected to the front side panel and in at least partial face-to-face contact with the second end side panel, a third tucking end flap foldably connected to the back side panel and in at least partial face-to-face contact with the first end side panel, and a fourth tucking end flap foldably connected to the back side panel and in at least partial face-to-face contact with the second end side panel.

13. A blank for forming a carrier for holding a plurality of containers, the blank comprising:

a plurality of panels comprising an attachment panel, a first side panel foldably connected to the attachment panel, and a second side panel foldably connected to the attachment panel;

container retention features comprising a plurality of container openings in the attachment panel for at least partially receiving a respective container of the plurality of containers when the carrier is formed from the blank; and locking features for maintaining a secure engagement of the carrier with the plurality of containers when the carrier is formed from the blank, the locking features comprising at least one locking tab foldably connected to one of the first side panel and the second side panel, and at least one locking cut for at least partially receiving the at least one locking tab when the carrier is formed from the blank, the at least one locking cut positioned in the other of the first side panel and the second side panel, the locking features for forming an at least partially curved corner of the carrier between the first side panel and the second side panel when the carrier is formed from the blank.

14. The blank of claim 13, wherein the locking features further comprise a tucking end flap foldably connected to the one of the first side panel and the second side panel having the at least one locking cut, the tucking end flap for at least partially overlapping the other of the first side panel and the second side panel when the carrier is formed from the blank.

15. The blank of claim 13, wherein the container retention features further comprise a plurality of container retention tabs foldably connected to the attachment panel and extending into a respective container opening of the plurality of container openings, the plurality of container retention tabs for engaging a respective container of the plurality of containers when the carrier is formed from the blank.

16. The blank of claim 15, further comprising handle features, the handle features comprising at least one handle opening at least partially formed in the attachment panel.

17. The blank of claim 13, wherein the first side panel is a front side panel, the second side panel is a first end side panel, the at least one locking tab is foldably connected to the front side panel, the at least one locking cut is positioned in the first end side panel, and the plurality of panels further comprises a back side panel foldably connected to the attachment panel and a second end side panel foldably connected to the attachment panel.

18. The blank of claim 17, wherein the at least one locking tab is a first locking tab foldably connected to the front side panel, the at least one locking cut is a first locking cut positioned in the first end side panel, and the locking features further comprise a second locking tab foldably connected to the front side panel, a third locking tab foldably connected to the back side panel, a fourth locking tab foldably connected to the back side panel, a second locking cut positioned in the first end side panel and for at least partially receiving the third locking tab when the carrier is formed from the blank, a third locking cut positioned in the second end side panel and for at least partially receiving the second locking tab when the carrier is formed from the blank, and a fourth locking cut positioned in the second end side panel and for at least partially receiving the fourth locking tab when the carrier is formed from the blank.

19. The blank of claim 13, wherein the first side panel is a front side panel, the second side panel is a first end side panel, the at least one locking tab is foldably connected to the first end side panel, the at least one locking cut is positioned in the front side panel, and the plurality of panels further comprises a back side panel foldably connected to the attachment panel and a second end side panel foldably connected to the attachment panel.

20. The blank of claim 19, wherein the at least one locking tab is a first locking tab foldably connected to the first end side panel, the at least one locking cut is a first locking cut positioned in the front side panel, and the locking features further comprise a second locking tab foldably connected to the first end side panel, a third locking tab foldably connected to the second end side panel, a fourth locking tab foldably connected to the second end side panel, a second locking cut positioned in the front side panel and for at least partially receiving the third locking tab when the carrier is formed from the blank, a third locking cut positioned in the back side panel and for at least partially receiving the second locking tab when the carrier is formed from the blank, and a fourth locking cut positioned in the back side panel and for at least partially receiving the fourth locking tab when the carrier is formed from the blank.

21. The blank of claim 20, wherein the locking features further comprise a first tucking end flap foldably connected to the front side panel and for being positioned in at least partial face-to-face contact with the first end side panel when the carrier is formed from the blank, a second tucking end flap foldably connected to the front side panel and for being positioned in at least partial face-to-face contact with the second end side panel when the carrier is formed from the blank, a third tucking end flap foldably connected to the back side panel and for being positioned in at least partial face-to-face contact with the first end side panel when the carrier is formed from the blank, and a fourth tucking end flap foldably connected to the back side panel and for being positioned in at least partial face-to-face contact with the second end side panel when the carrier is formed from the blank.

22. The blank of claim 13, wherein at least a portion of the first side panel is for being curved to at least partially form the at least partially curved corner of the carrier formed from the blank.

23. A method of forming a carrier for holding a plurality of containers, the method comprising:

obtaining a blank, the blank comprising a plurality of panels comprising an attachment panel, a first side panel foldably connected to the attachment panel, and a second side panel foldably connected to the attachment panel, the blank further comprising container retention features comprising a plurality of container openings in the attachment panel, the blank further comprising locking features comprising at least one locking tab foldably connected to one of the first side panel and the second side panel, and at least one locking cut positioned in the other of the first side panel and the second side panel;

positioning the at least one locking cut at least partially receiving the at least one locking tab; and positioning the locking feature forming an at least partially curved corner of the carrier between the first side panel and the second side panel.

24. The method of claim 23, wherein positioning the locking features further comprises at least partially curving at least a portion of the first side panel is curved to at least partially form the at least partially curved corner.

25. The method of claim 24, wherein the locking features further comprise a tucking end flap foldably connected to the one of the first side panel and the second side panel having the at least one locking cut, and the method further comprises positioning the tucking end flap at least partially overlapping the other of the first side panel and the second side panel.

26. The method of claim 24, wherein the container retention features further comprise a plurality of container retention tabs foldably connected to the attachment panel and extending into a respective container opening of the plurality of container openings, the plurality of container retention tabs for engaging a respective container of the plurality of containers.

27. The method of claim 26, further comprising handle features, the handle features comprising at least one handle opening at least partially formed in the attachment panel.

28. The method of claim 26, further comprising at least partially receiving a respective container of the plurality of containers through a respective container opening of the plurality of container openings.

29. The method of claim 23, wherein the first side panel is a front side panel, the second side panel is a first end side panel, the at least one locking tab is foldably connected to the front side panel, the at least one locking cut is positioned in the first end side panel, and the plurality of panels further comprises a back side panel foldably connected to the attachment panel and a second end side panel foldably connected to the attachment panel.

30. The method of claim 29, wherein the at least one locking tab is a first locking tab foldably connected to the front side panel, the at least one locking cut is a first locking cut positioned in the first end side panel, and the locking features further comprise a second locking tab foldably connected to the front side panel, a third locking tab foldably connected to the back side panel, a fourth locking tab foldably connected to the back side panel, a second locking cut positioned in the first end side panel, a third locking cut positioned in the second end side panel, and a fourth locking cut positioned in the second end side panel, and the method further comprises positioning the second locking cut at least partially receiving the third locking tab, positioning the third locking cut and at least partially receiving the second locking tab, and positioning the fourth locking cut at least partially receiving the fourth locking tab.

31. The method of claim 30, wherein positioning the locking features forms at least partially curved corner between the front side panel and the first end side panel being a first at least partially curved corner, and the method further comprises positioning the locking features to form a second at least partially curved corner between the front side panel and the second end side panel, a third at least partially curved corner between the second end side panel and the back side panel, and a fourth at least partially curved corner between the back side panel and the first end side panel.

32. The method of claim 31, further comprising at least partially receiving a respective container of the plurality of containers through a respective container opening of the plurality of container openings.

33. The method of claim 23, wherein the first side panel is a front side panel, the second side panel is a first end side panel, the at least one locking tab is foldably connected to the first end side panel, the at least one locking cut is positioned in the front side panel, and the plurality of panels further comprises a back side panel foldably connected to the attachment panel and a second end side panel foldably connected to the attachment panel.

34. The method of claim 33, wherein the at least one locking tab is a first locking tab foldably connected to the first end side panel, the at least one locking cut is a first locking cut positioned in the front side panel, and the locking features further comprise a second locking tab foldably connected to the first end side panel, a third locking tab foldably connected to the second end side panel, a fourth locking tab foldably connected to the second end side panel, a second locking cut positioned in the front side panel, a third locking cut positioned in the back side panel, and a fourth locking cut positioned in the back side panel, and the method further comprises positioning the second locking cut at least partially receiving the third locking tab, positioning the third locking cut and at least partially receiving the second locking tab, and positioning the fourth locking cut at least partially receiving the fourth locking tab.

35. The method of claim 34, further comprising positioning the locking features to form a first at least partially curved corner between the front side panel and the first end side panel, a second at least partially curved corner between the front side panel and the second end side panel, a third at least partially curved corner between the second end side panel and the back side panel, and a fourth at least partially curved corner between the back side panel and the first end side panel.

36. The method of claim 35, wherein the locking features further comprise a first tucking end flap foldably connected to the front side panel, a second tucking end flap foldably connected to the front side panel, a third tucking end flap foldably connected to the back side panel, and a fourth tucking end flap foldably connected to the back side panel, and the method further comprises positioning the first tucking end flap in at least partial face-to-face contact with the first end side panel, positioning the second tucking end flap in at least partial face-to-face contact with the second end side panel, positioning the third tucking end flap in at least partial face-to-face contact with the first end side panel, and positioning the fourth tucking end flap in at least partial face-to-face contact with the second end side panel.

37. The method of claim 36, further comprising at least partially receiving a respective container of the plurality of containers through a respective container opening of the plurality of container openings.

38. A package, the package comprising:

a plurality of containers; and a carrier, the carrier comprising:

a plurality of panels comprising an attachment panel, a first side panel foldably connected to the attachment panel, and a second side panel foldably connected to the attachment panel;

container retention features comprising a plurality of container openings in the attachment panel at least partially receiving a respective container of the plurality of containers; and locking features maintaining a secure engagement of the carrier with the plurality of containers, the locking features comprising at least one locking tab foldably connected to one of the first side panel and the second side panel, and at least one locking cut at least partially receiving the at least one locking tab, the at least one locking cut positioned in the other of the first side panel and the second side panel, the locking features forming an at least partially curved corner of the carrier between the first side panel and the second side panel.

39. The package of claim 38, wherein at least a portion of the first side panel is curved to at least partially form the at least partially curved corner.

40. The package of claim 39, wherein the locking features further comprise a tucking end flap foldably connected to the one of the first side panel and the second side panel having the at least one locking cut, the tucking end flap at least partially overlapping the other of the first side panel and the second side panel.

41. The package of claim 39, wherein the container retention features further comprise a plurality of container retention tabs foldably connected to the attachment panel and extending into a respective container opening of the plurality of container openings, the plurality of container retention tabs engaging a respective container of the plurality of containers.

42. The package of claim 41, further comprising handle features, the handle features comprising at least one handle opening at least partially formed in the attachment panel.

43. The package of claim 38, wherein the first side panel is a front side panel, the second side panel is a first end side panel, the at least one locking tab is foldably connected to the front side panel, the at least one locking cut is positioned in the first end side panel, and the plurality of panels further comprises a back side panel foldably connected to the attachment panel and a second end side panel foldably connected to the attachment panel.

44. The package of claim 43, wherein the at least one locking tab is a first locking tab foldably connected to the front side panel, the at least one locking cut is a first locking cut positioned in the first end side panel, and the locking features further comprise a second locking tab foldably connected to the front side panel, a third locking tab foldably connected to the back side panel, a fourth locking tab foldably connected to the back side panel, a second locking cut positioned in the first end side panel and at least partially receiving the third locking tab, a third locking cut positioned in the second end side panel and at least partially receiving the second locking tab, and a fourth locking cut positioned in the second end side panel and at least partially receiving the fourth locking tab.

45. The package of claim 44, wherein the locking features form the at least partially curved corner between the front side panel and the first end side panel being a first at least partially curved corner, a second at least partially curved corner between the front side panel and the second end side panel, a third at least partially curved corner between the second end side panel and the back side panel, and a fourth at least partially curved corner between the back side panel and the first end side panel.

46. The package of claim 38, wherein the first side panel is a front side panel, the second side panel is a first end side panel, the at least one locking tab is foldably connected to the first end side panel, the at least one locking cut is positioned in the front side panel, and the plurality of panels further comprises a back side panel foldably connected to the attachment panel and a second end side panel foldably connected to the attachment panel.

47. The package of claim 46, wherein the at least one locking tab is a first locking tab foldably connected to the first end side panel, the at least one locking cut is a first locking cut positioned in the front side panel, and the locking features further comprise a second locking tab foldably connected to the first end side panel, a third locking tab foldably connected to the second end side panel, a fourth locking tab foldably connected to the second end side panel, a second locking cut positioned in the front side panel and at least partially receiving the third locking tab, a third locking cut positioned in the back side panel and at least partially receiving the second locking tab, and a fourth locking cut positioned in the back side panel and at least partially receiving the fourth locking tab.

48. The package of claim 47, wherein the locking features form a first at least partially curved corner between the front side panel and the first end side panel, a second at least partially curved corner between the front side panel and the second end side panel, a third at least partially curved corner between the second end side panel and the back side panel, and a fourth at least partially curved corner between the back side panel and the first end side panel.

49. The package of claim 48, wherein the locking features further comprise a first tucking end flap foldably connected to the front side panel and in at least partial face-to-face contact with the first end side panel, a second tucking end flap foldably connected to the front side panel and in at least partial face-to-face contact with the second end side panel, a third tucking end flap foldably connected to the back side panel and in at least partial face-to-face contact with the first end side panel, and a fourth tucking end flap foldably connected to the back side panel and in at least partial face-to-face contact with the second end side panel.

* * * * *